US010703599B2

(12) United States Patent
Kanematsu

(10) Patent No.: US 10,703,599 B2
(45) Date of Patent: Jul. 7, 2020

(54) PRINTING APPARATUS THAT PROMPTS A USER TO ATTACH AN ATTACHMENT IN ACCORDANCE WITH THE TYPE OR ORIENTATION OF AN ENVELOPE TO BE USED IN PRINTING, AND RELATED METHOD OF CONTROLLING THE PRINTING APPARATUS AND STORAGE MEDIUM

(71) Applicant: CANON KABUSHIKI KAISHA, Tokyo (JP)

(72) Inventor: Shinichi Kanematsu, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/915,373

(22) Filed: Mar. 8, 2018

(65) Prior Publication Data

US 2018/0194587 A1 Jul. 12, 2018

Related U.S. Application Data

(63) Continuation of application No. 14/742,133, filed on Jun. 17, 2015, now Pat. No. 9,969,591.

(30) Foreign Application Priority Data

Jun. 25, 2014 (JP) ..... 2014-130689

(51) Int. Cl.
*B65H 43/00* (2006.01)
*G03G 15/00* (2006.01)

(52) U.S. Cl.
CPC ..... *B65H 43/00* (2013.01); *G03G 15/502* (2013.01); *G03G 15/55* (2013.01);
(Continued)

(58) Field of Classification Search
CPC ..... B65H 7/00; B65H 43/00; B65H 2551/00; B65H 1/04; B65H 2701/1916;
(Continued)

(56) References Cited

U.S. PATENT DOCUMENTS 5,599,120 A * 2/1997 Conrad ..... B41J 13/103 271/145
5,823,522 A * 10/1998 Fujiwara ..... G06K 13/16 271/4.08
(Continued)

FOREIGN PATENT DOCUMENTS

CN 103182859 A 7/2013
CN 103287123 A 9/2013
(Continued)

OTHER PUBLICATIONS

Office Action dated Mar. 29, 2017, in Chinese Patent Application No. 201510354532.
(Continued)

*Primary Examiner* — Thomas A Morrison
(74) *Attorney, Agent, or Firm* — Venable LLP

(57) ABSTRACT

An image forming apparatus includes a stacking unit for stacking types of envelopes, an image forming unit that forms an image on a conveyed envelope, a rear-end regulating plate, provided on the stacking unit, that regulates a trailing end of the stacked envelope at an upstream side of a conveyance direction, side regulating plates, provided on the stacking unit, that regulate both side ends of the stacked envelope in a perpendicular direction to the conveyance direction, an attachment, removably mounted on the stacking unit, that regulates a trailing end of the stacked envelope, an operation unit that accepts a type of envelope via an instruction by a user, and a controller that determines, based on the type of the accepted envelope, whether the attachment is necessary, and, if it is determined that the attachment is
(Continued)

necessary, displays information, on the operation unit, prompting the user to mount the attachment.

10 Claims, 14 Drawing Sheets

(52) U.S. Cl.
CPC ..... *G03G 15/6502* (2013.01); *G03G 15/6594* (2013.01); *B65H 2701/1916* (2013.01); *B65H 2801/06* (2013.01); *G03G 2215/00514* (2013.01)

(58) Field of Classification Search
CPC .. B65H 2801/06; G03G 15/502; G03G 15/55; G03G 15/6502; G03G 15/6594; G03G 2215/00514
See application file for complete search history.

(56) References Cited

U.S. PATENT DOCUMENTS

| | | | | |
|---|---|---|---|---|
| 7,236,846 | B1 | 6/2007 | Koyama et al. | |
| 8,746,684 | B2 * | 6/2014 | Okano | B65H 31/00 271/145 |
| 8,840,101 | B2 | 9/2014 | Yamada | |
| 8,876,101 | B2 | 11/2014 | Saito | |
| 9,415,962 | B2 | 8/2016 | Yamada | |
| 2004/0225390 | A1 | 11/2004 | Keller et al. | |
| 2005/0184144 | A1 | 8/2005 | Eastman et al. | |
| 2008/0198398 | A1 | 8/2008 | Sasamae | |
| 2009/0150117 | A1 * | 6/2009 | Krasuski | G01B 5/02 702/163 |
| 2011/0144808 | A1 | 6/2011 | Zukowski et al. | |
| 2011/0184889 | A1 * | 7/2011 | Tokita | B65H 1/00 705/414 |
| 2011/0217107 | A1 | 9/2011 | Usui | |
| 2011/0255882 | A1 | 10/2011 | Yoshimura | |
| 2014/0368847 | A1 | 12/2014 | Kanematsu | |
| 2015/0036172 | A1 | 2/2015 | Tachibana | |

FOREIGN PATENT DOCUMENTS

| | | | |
|---|---|---|---|
| JP | S62-017644 | U | 2/1987 |
| JP | 63-166539 | * | 10/1988 |
| JP | H03-053933 | U | 5/1991 |
| JP | 5-092841 | A | 4/1993 |
| JP | H11-059925 | A | 3/1999 |
| JP | H11-106059 | A | 4/1999 |
| JP | 2002-362757 | A | 12/2002 |
| JP | 2003-107961 | A | 4/2003 |
| JP | 2005-231821 | A | 9/2005 |
| JP | 2007-076875 | A | 3/2007 |
| JP | 2008-184247 | A | 8/2008 |
| JP | 2014-083841 | A | 5/2014 |

OTHER PUBLICATIONS

Office Action dated Mar. 16, 2018, issued in Japanese Patent Application No. 2015-252402.

* cited by examiner

WHETHER ATTACHMENT IS NECESSARY

| ENVELOPE TYPE | SHORT-EDGE FEED | LONG-EDGE FEED |
|---|---|---|
| LONG NO. 3 | ○ | ○ |
| SQUARE NO. 2 | × | ○ |
| COM10 | ○ | ○ |
| C5 | ○ | × |

PRINTING APPARATUS THAT PROMPTS A USER TO ATTACH AN ATTACHMENT IN ACCORDANCE WITH THE TYPE OR ORIENTATION OF AN ENVELOPE TO BE USED IN PRINTING, AND RELATED METHOD OF CONTROLLING THE PRINTING APPARATUS AND STORAGE MEDIUM

This application is a continuation application of U.S. patent application Ser. No. 14/742,133, filed Jun. 17, 2015, which claims the benefit of Japanese Patent Application No. 2014-130689 filed on Jun. 25, 2014 which are hereby incorporated by reference herein in their entireties.

BACKGROUND OF THE INVENTION

Field of the Invention

The present invention relates to a printing apparatus, a method of controlling the printing apparatus, and a storage medium.

Description of the Related Art

Many printing apparatuses can form images on various kinds of printing media. These printing media have various types that are different in size, thickness, rigidity, and the like. To improve the quality of a printed product, therefore, it is sometimes necessary to use a dedicated paper feed attachment or a dedicated paper feed tray for each printing medium. Especially when using an envelope as a printing medium, the printing quality may deteriorate if the user fails to correctly determine whether to use a necessary attachment, or the setting orientation of the envelope. Therefore, envelopes are difficult to use for users.

Various methods have been proposed to eliminate this difficulty in determination and mistake in setting of an envelope. For example, Japanese Patent Laid-Open No. 5-92841 describes a method that detects the front/back and orientation of an envelope set in a paper feed cassette, and, if the placement of the envelope is incorrect, notifies the user of this information, or interrupts printing.

In the above-mentioned related art, however, when a user intends to perform printing on a given printing medium, the difficulty in determining a necessary attachment and whether to use it has not been eliminated. For example, there are various kinds of envelopes, so a printing apparatus may require an attachment for a given envelope but may not require any attachment for another envelope. In addition, the type of attachment to be used sometimes changes in accordance with the feed direction (orientation) of an envelope. Also, whether an attachment is necessary sometimes changes even for the same envelope in accordance with the conveying direction of the envelope. When using an envelope, as a printing medium, therefore, it is difficult to determine whether an attachment is necessary, and to determine the type of attachment to be used.

Furthermore, when a printing apparatus shifts from a state in which a necessary attachment is attached and printing is performed on a printing medium to a state of printing that is performed on a printing medium requiring another kind of attachment, it is difficult for the user to determine what process to perform.

SUMMARY OF THE INVENTION

An aspect of the present invention is to eliminate the above-mentioned problems with conventional technology.

A feature of the present invention is to provide a technique of properly prompting attaching of an attachment in accordance with the type or orientation of an envelope to be used in printing.

According to a first aspect, the present invention provides a printing apparatus for conveying an envelope set in a paper feed unit and performing printing on the envelope, the apparatus comprising a determination unit configured to determine whether or not attaching of an attachment to the paper feed unit is necessary in accordance with a type of an envelope to be used and a control unit configured to control to display a message prompting attaching of the attachment, if the determination unit determines that attaching of the attachment is necessary.

According to a second aspect, the present invention provides a printing apparatus for conveying an envelope set in a paper feed unit and performing printing on the envelope, the apparatus comprising a determination unit configured to determine whether or not attaching of an attachment to the paper feed unit is necessary in accordance with an orientation of an envelope to be used and a control unit configured to control to display a message prompting attaching of the attachment, if the determination unit determines that attaching of the attachment is necessary.

According to a third aspect, the present invention provides a method of controlling a printing apparatus for conveying an envelope set in a paper feed unit and performing printing on the envelope, the method comprising determining whether or not attaching of an attachment is necessary in accordance with a type of an envelope to be used and controlling to display a message prompting attaching of the attachment, if it is determined, in the determining, that attaching of the attachment is necessary.

According to a fourth aspect, the present invention provides a method of controlling a printing apparatus for conveying an envelope set in a paper feed unit and performing printing on the envelope, the method comprising determining whether or not attaching of an attachment to the paper feed unit is necessary in accordance with a type of an envelope to be used and controlling to display a message prompting attaching of the attachment, if it is determined, in the determining, that attaching of the attachment is necessary.

According to a fifth aspect, the present invention provides a method of controlling a printing apparatus for conveying an envelope set in a paper feed unit and performing printing on the envelope, the method comprising determining whether or not attaching of an attachment to the paper feed unit is necessary in accordance with an orientation of an envelope to be used and controlling to display a message prompting attaching of the attachment, if it is determined in the determining that attaching of the attachment is necessary.

Further features of the present invention will become apparent from the following description of exemplary embodiments, with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Embodiments of the present invention will now be described hereafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Figure 1:
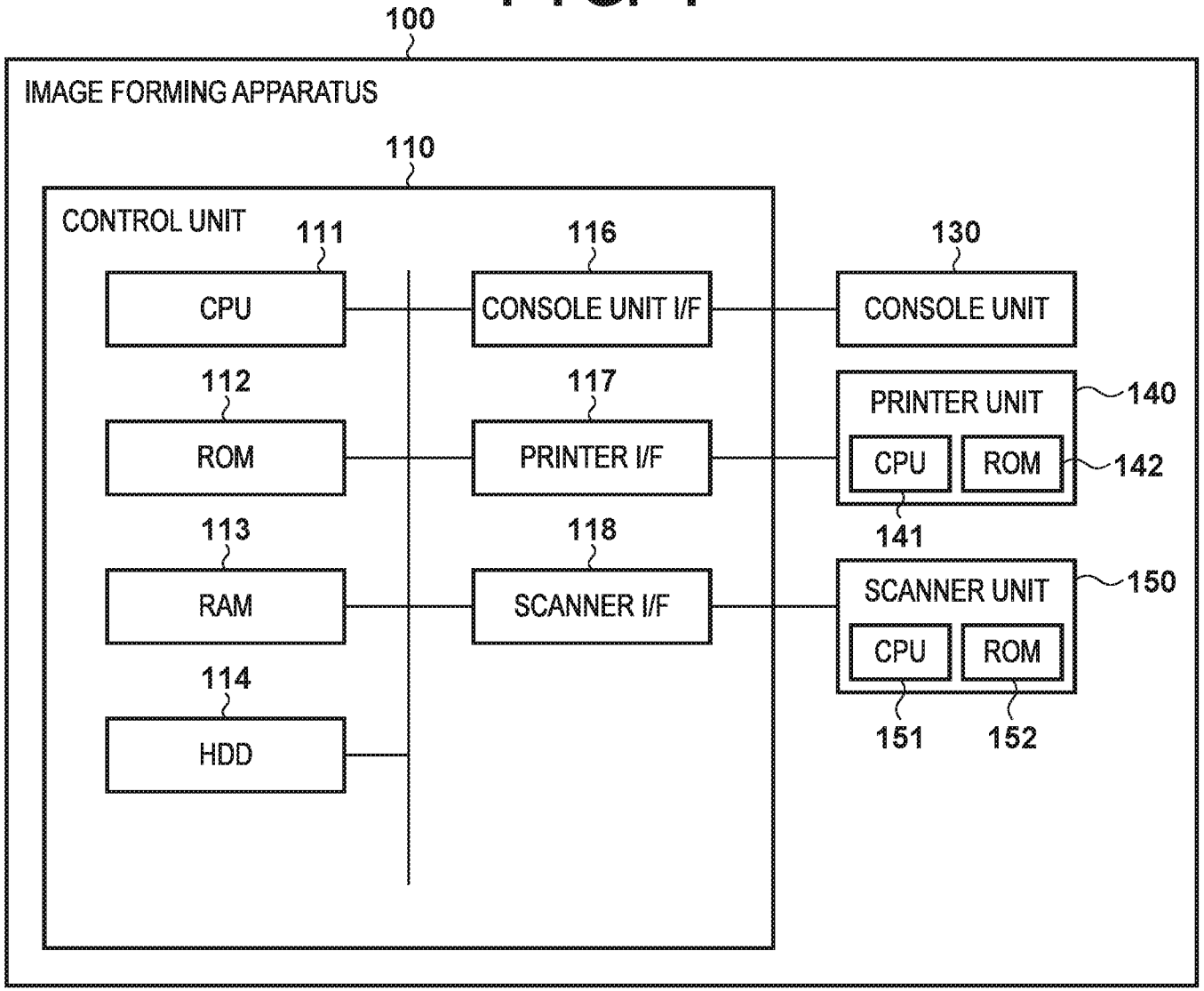
FIG. 1 is a block diagram for describing the hardware configuration of an image forming apparatus according to a first embodiment of the present invention.

FIG. 1 is a block diagram for explaining the hardware configuration of an image forming apparatus 100 according to the first embodiment of the present invention.

The image forming apparatus 100 is a multifunctional processing apparatus capable of printing and scanning of original, and includes a control unit 110, console unit 130, printer unit 140, and scanner unit 150. The control unit 110 controls the operation of the whole image forming apparatus 100. The arrangement of the control unit 110 will be explained below. A central processing unit (CPU) 111 controls the operation of the whole apparatus by executing a boot program stored in a read only memory (ROM) 112, deploying an operating system (OS) and control programs stored in a hard disk drive (HDD) 114 on a random-access memory (RAM) 113, and executing the OS and the programs. The programs to be executed by the CPU 111 include a scanning program and a printing program. When the scanning program is executed, image data of an original scanned by the scanner unit 150 is obtained. When the printing program is executed, the printer unit 140 prints an image. A console unit interface (I/F) 116 transmits information input by the user via the console unit 130 to the CPU 111, and displays a message, menu, and the like, on a display unit of the console unit 130 in accordance with instructions of the CPU 111. Note that the console unit 130 includes a display unit (or a Graphical User Interface (GUI)) having a touch panel function, a keyboard, and the like, accepts instructions from the user, and provides various kinds of information to the user. A printer I/F 117 connects the control unit 110 and the printer unit 140, and the printer unit 140 prints an image on a printing medium based on image data transferred via the printer I/F 117. A scanner I/F 118 connects the control unit 110 and the scanner unit 150. The scanner unit 150 scans an image on an original using a line sensor, and transfers image data obtained by the scanning to the control unit 110 via the scanner I/F 118. The HDD 114 stores image data input via the scanner I/F 118, and the stored image data is output to the printer unit 140 via the printer I/F 117 and is printed. A copying operation can be performed by thus printing, by the printer unit 140, the image data of an original obtained by the scanner unit 150. Note that the printer unit 140 and the scanner unit 150 respectively include CPUs 141 and 151 and ROMs 142 and 152, and each CPU reads out and executes firmware stored in a corresponding ROM. Accordingly, the printer unit 140 and the scanner unit 150 can execute operations corresponding to instructions from the control unit 110.

Next, the configuration of software to be executed by the CPU 111 of the control unit 110 will be explained with reference to FIG. 2. Note that this software is stored in the HDD (Hard Disk Drive) 114, shown in FIG. 1.

Figure 2:
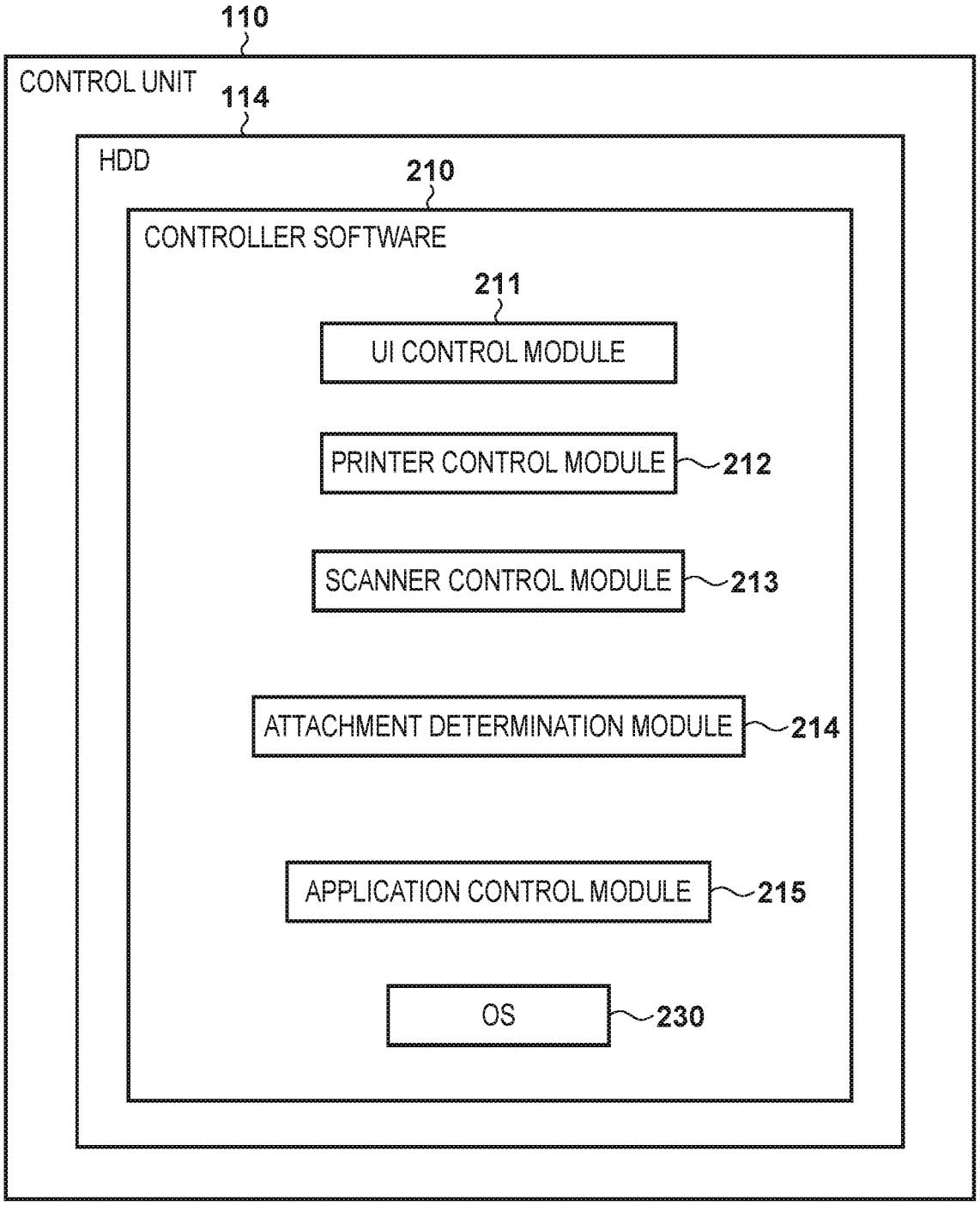
FIG. 2 is a block diagram for explaining the software configuration of the image forming apparatus according to the first embodiment.

FIG. 2 is a block diagram for explaining the software configuration of the image forming apparatus 100 according to the first embodiment.

In controller software 210, firmware for implementing various functions of the image forming apparatus 100 according to the first embodiment is arranged. A UI control module 211 controls the console unit 130 via the console I/F 116. A printer control module 212 controls the printer unit 140 via the printer I/F 117. A scanner control module 213 controls the scanner unit 150 via the scanner I/F 118. An attachment determination module 214 determines whether or not an envelope attachment (to be described later) is necessary. An application control module 215 is a group of firmware for implementing various functions of the image forming apparatus 100. An OS 230 includes an operating system (OS), a basic input output system (BIOS), and the like.

Figure 3:
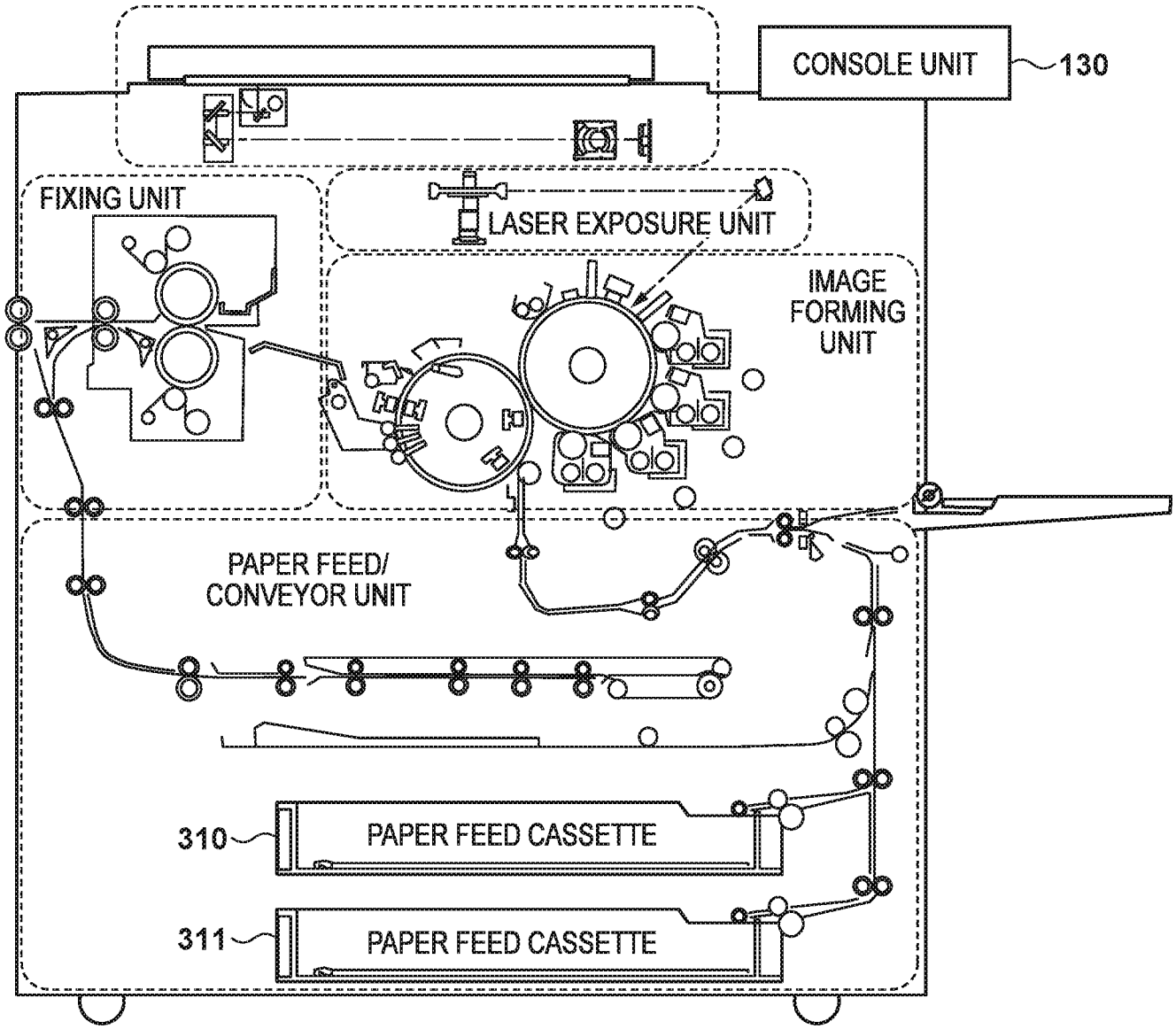
FIG. 3 depicts a view for explaining the mechanism of the image forming apparatus according to the first embodiment.

FIG. 3 depicts a view for explaining the mechanism of the image forming apparatus 100 according to the first embodiment.

A printing medium (for example, paper, a sheet, or an envelope) is stacked in a paper feed cassette 310 or 311 (a paper feed unit), and is conveyed to an image forming unit by a paper feed/conveyor unit. A desired image is formed on the conveyed printing medium through the image forming unit and a fixing unit, and the printing medium, on which the image has been formed, is discharged outside the image forming apparatus 100. In the paper feed cassette 310 and 311, plain paper having, for example, A4, LTR, A3, or B4 size, or a standard-size printing medium (paper or a sheet) is accommodated.

The image forming apparatus 100 is configured to form an image by feeding a printing medium other than the plain paper and the standard-size printing medium from the paper feed cassette 310, and various envelopes can be used as printing media. In this case, an envelope attachment is sometimes necessary in order to maintain the printing quality and to avoid a paper feed error in accordance with the type and the size of the envelope to be used and the feed direction (orientation) (short-edge feed or long-edge feed) of the envelope.

Figure 5A:
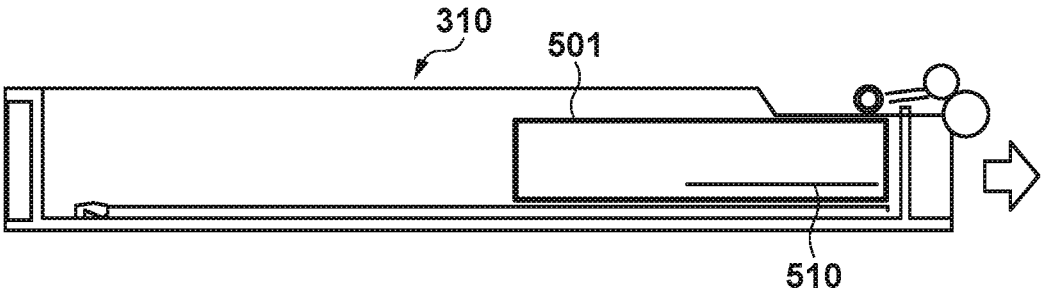
FIGS. 5A and 5B depict a side view and plan view, respectively, when an envelope in a paper feed cassette according to the first embodiment is conveyed by short-edge feed.
Figure 5B:
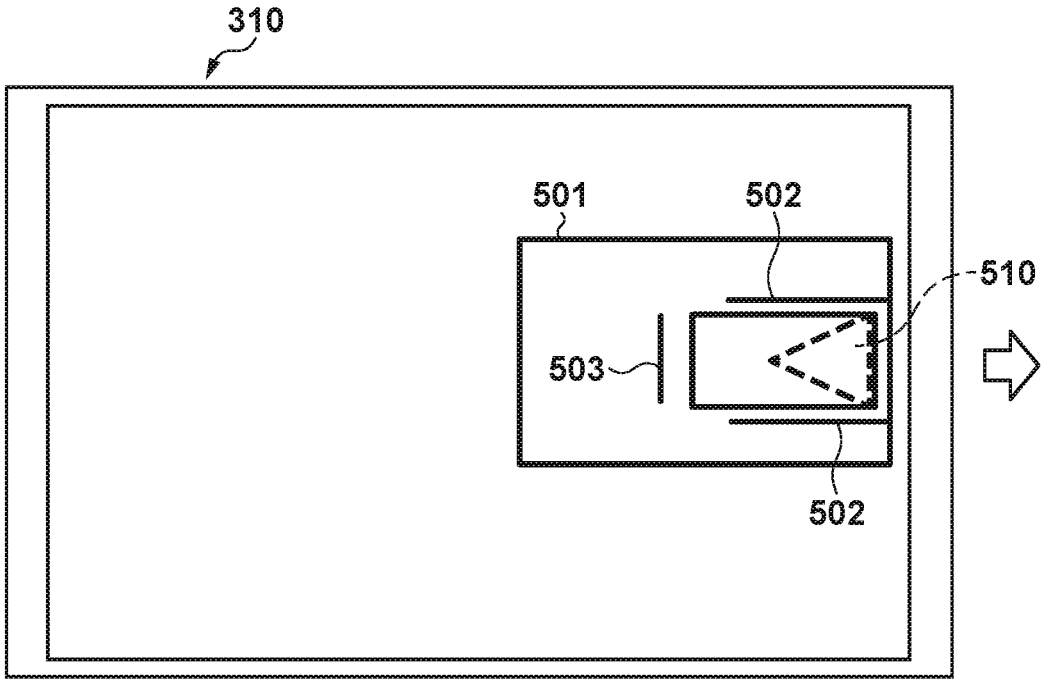

FIGS. 5A and 5B depict a side view and a plan view, respectively, when an envelope in the paper feed cassette 310 according to the first embodiment is conveyed by short-edge feed. FIG. 5A depicts the side view of the paper feed cassette 310, and FIG. 5B depicts the plan view of the paper feed cassette 310.

An attachment 501 is a short-edge feed attachment necessary for short-edge feed (conveyance in the longitudinal direction). The short-edge feed attachment 501 is installed inside the paper feed cassette 310, and increases the stability of envelope conveyance when feeding an envelope smaller than the standard size. The short-edge feed attachment 501 includes side regulating plates 502 and a rear-end regulating plate 503, and has an effect of suppressing a deviation of a stacked envelope 510 in the feed direction and preventing a feed error. The short-edge feed attachment 501 is installed in the paper feed cassette 310 (to be described later with reference to FIG. 7) so as to cover side regulating plates 392 (FIG. 7) and a rear-end regulating plate 393 (FIG. 7) of the paper feed cassette 310.

Figure 6A:
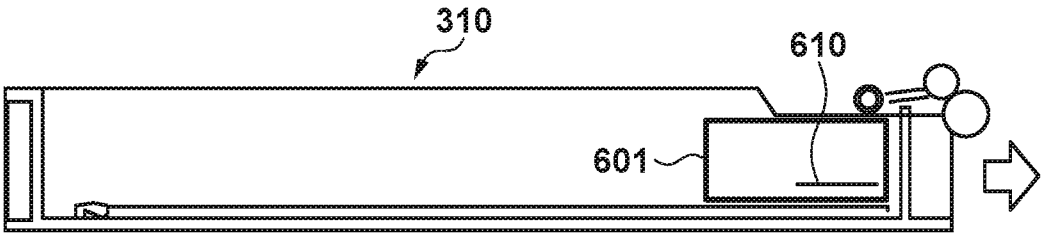
FIGS. 6A and 6B depict a side view and plan view, respectively, when an envelope in the paper feed cassette according to the first embodiment is conveyed by long-edge feed.
Figure 6B:
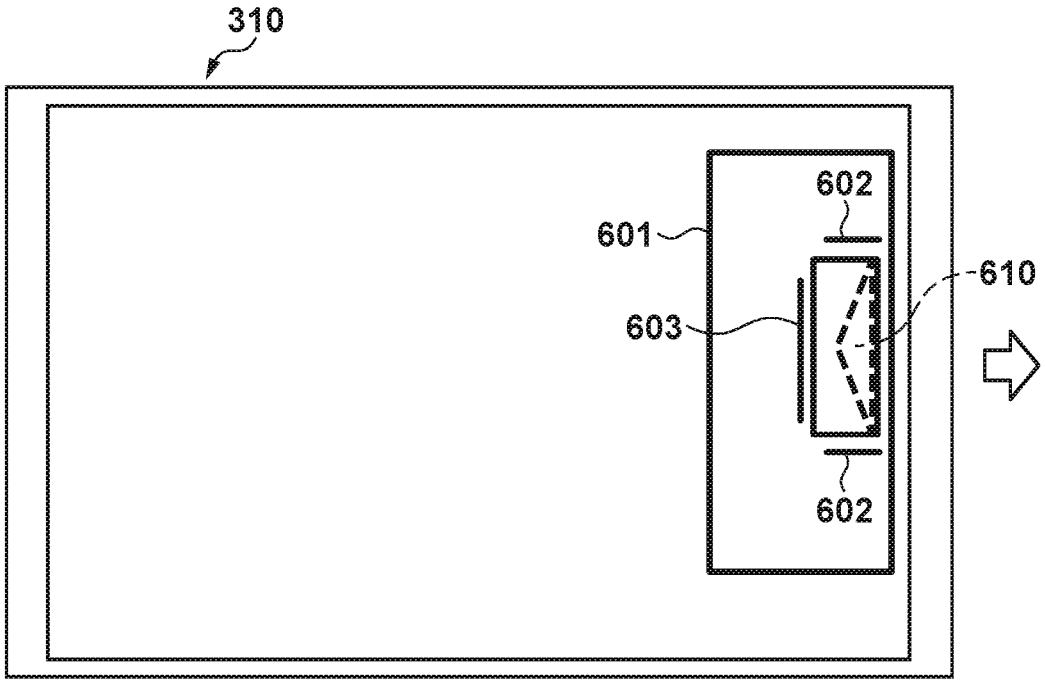

FIGS. 6A and 6B depict a side view and a plan view, respectively, when an envelope 610 in the paper feed cassette 310 according to the first embodiment is conveyed by long-edge feed. FIG. 6A depicts the side view of the paper feed cassette 310, and FIG. 6B depicts the plan view of the paper feed cassette 310.

An attachment 601 is a long-edge feed attachment necessary for long-edge feed (conveyance in the widthwise direction). The long-edge feed attachment 601 is installed inside the paper feed cassette 310, and has the same basic arrangement and effect as those of the short-edge feed attachment 501 shown in FIGS. 5A and 5B. In the case of long-edge feed shown in FIGS. 6A and 6B, however, side regulating plates 602 are set wider in the paper feed direction so as to correspond to the long edge of the envelope, and a rear-end regulating plate 603 is set narrower in the paper feed direction, compared to the short-edge feed attachment 501 in FIGS. 5A and 5B. Since a physical structural difference like this is produced, the short-edge feed attachment 501 and the long-edge feed attachment 601 are formed as different attachments. The long-edge feed attachment 601 is also installed in the paper feed cassette 310 so as to cover the side regulating plates 392 and the rear-end regulating plate 393 of the paper feed cassette 310, to be described below with reference to FIGS. 7A and 7B.

Figure 7A:
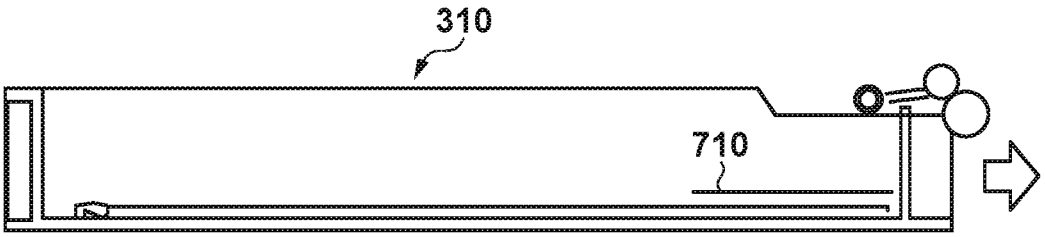
FIGS. 7A and 7B depict a side view and plan view, respectively, when setting an envelope requiring no envelope attachment in the paper feed cassette according to the first embodiment.
Figure 7B:
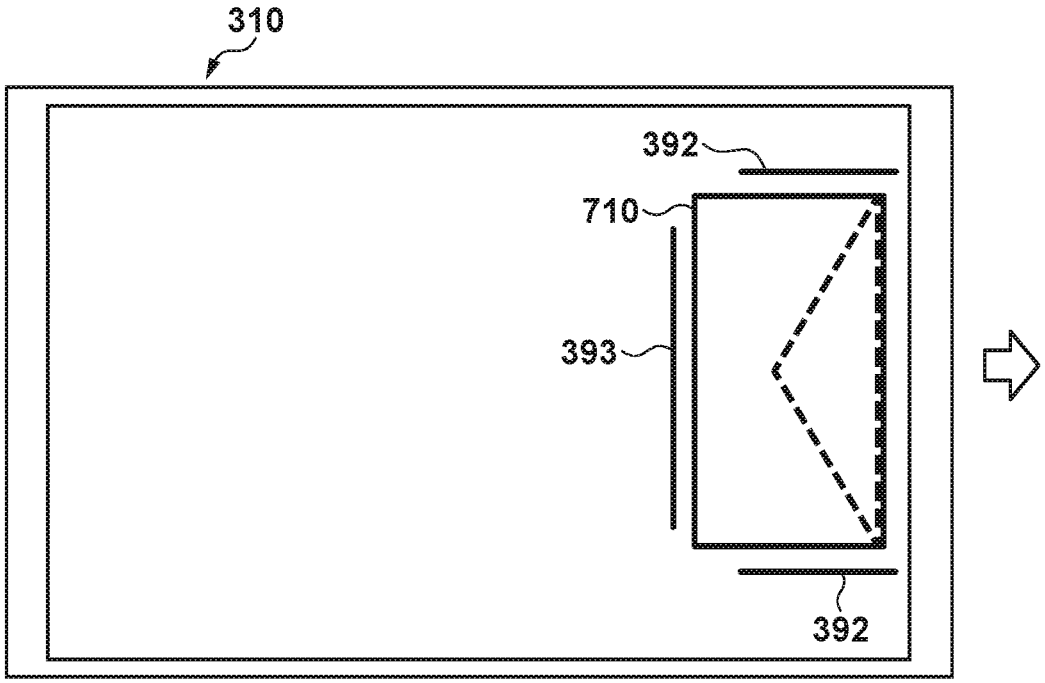

FIGS. 7A and 7B depict a side view and a plan view, respectively, when an envelope 710 requiring no envelope attachment is stacked in the paper feed cassette 310 according to the first embodiment. FIG. 7A depicts the side view of the paper feed cassette 310, and FIG. 7B depicts the plan view of the paper feed cassette 310.

The envelope 710 shown in FIGS. 7A and 7B can be fed sufficiently stably by the side regulating plates 392 and the rear-end regulating plate 393 for stably feeding standard-size paper, which are originally included in the paper feed cassette 310. As shown in FIGS. 7A and 7B, the envelope 710 of this type can directly be set on the paper feed cassette 310 without using any attachment. In addition, the stability of feed of the envelope 710 increases when no attachment is used, so no attachment should be used.

Figures 8, 9:
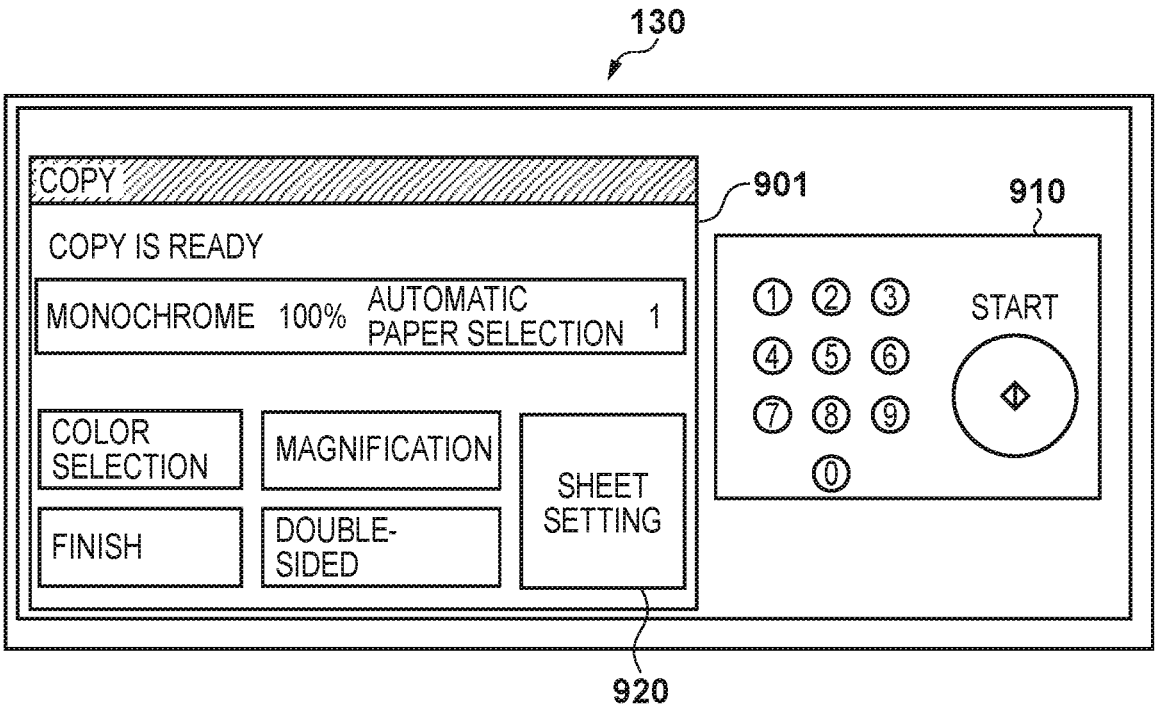
FIG. 8 depicts a table defining whether an envelope attachment is necessary for each of short-edge feed and long-edge feed, in association with the type of envelope usable in the image forming apparatus according to the first embodiment.
FIG. 9 depicts a plan view of a console unit of the image forming apparatus according to the first embodiment.

FIG. 8 depicts a table defining whether an envelope attachment is necessary for each of short-edge feed and long-edge feed in association with the type of envelope usable in the image forming apparatus 100 according to the first embodiment.

Referring to FIG. 8, each of a long No. 3 (N3) envelope and a COM10 envelope requires an attachment (indicated by o) in both short-edge feed and long-edge feed. A square No. 2 envelope, however, requires no attachment (indicated by x) in short-edge feed, and a C5 envelope requires no attachment in long-edge feed. Note that attachments for use in short-edge feed and long-edge feed are different, as described previously.

FIG. 9 depicts a plan view of the console unit 130 of the image forming apparatus 100 according to the first embodiment.

The console unit 130 includes a display unit 901 having a touch panel function, and a hard key unit 910. As shown in FIG. 9, the display unit 901 displays, for example, a function currently being usable, the feasibility of job acceptance, and the current job setting. When a sheet setting button 920 is pressed, a sheet setting screen (to be described later) is displayed.

Figure 4:
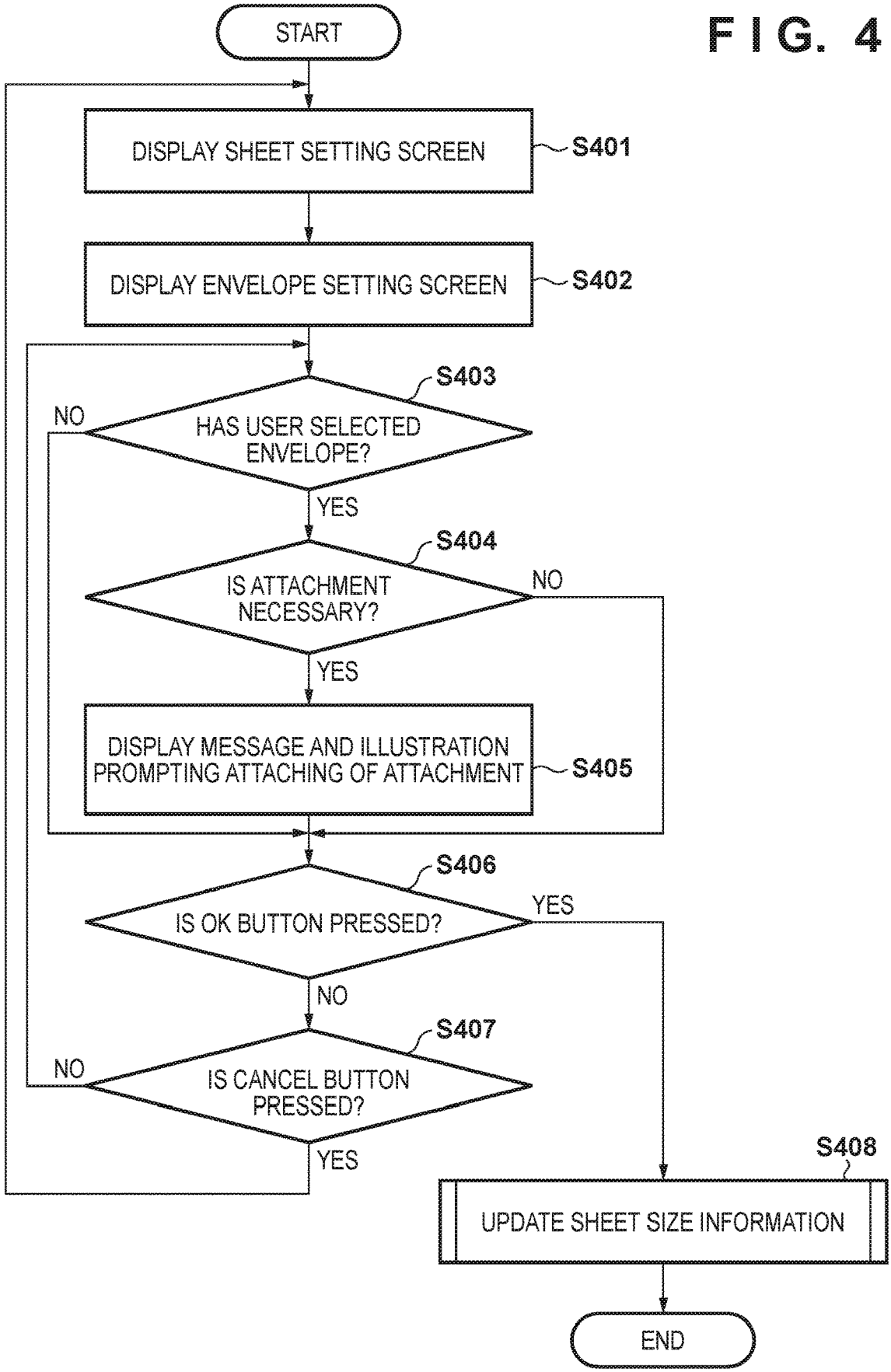
FIG. 4 is a flowchart for describing a setting process and display process when setting an envelope as a printing medium in the image forming apparatus according to the first embodiment.

FIG. 4 is a flowchart for describing a setting process and display process when setting an envelope as a printing medium in the image forming apparatus 100 according to the first embodiment. A program for executing this flowchart is stored in the HDD 114 of the control unit 110, and the processing is implemented by the CPU 111 by deploying the program on the RAM 113 and executing the program.

This processing is started when the user presses the sheet setting button 920 shown in FIG. 9. First, in step S401, the CPU 111 displays a sheet setting screen as shown in FIG. 10.

Figure 10:
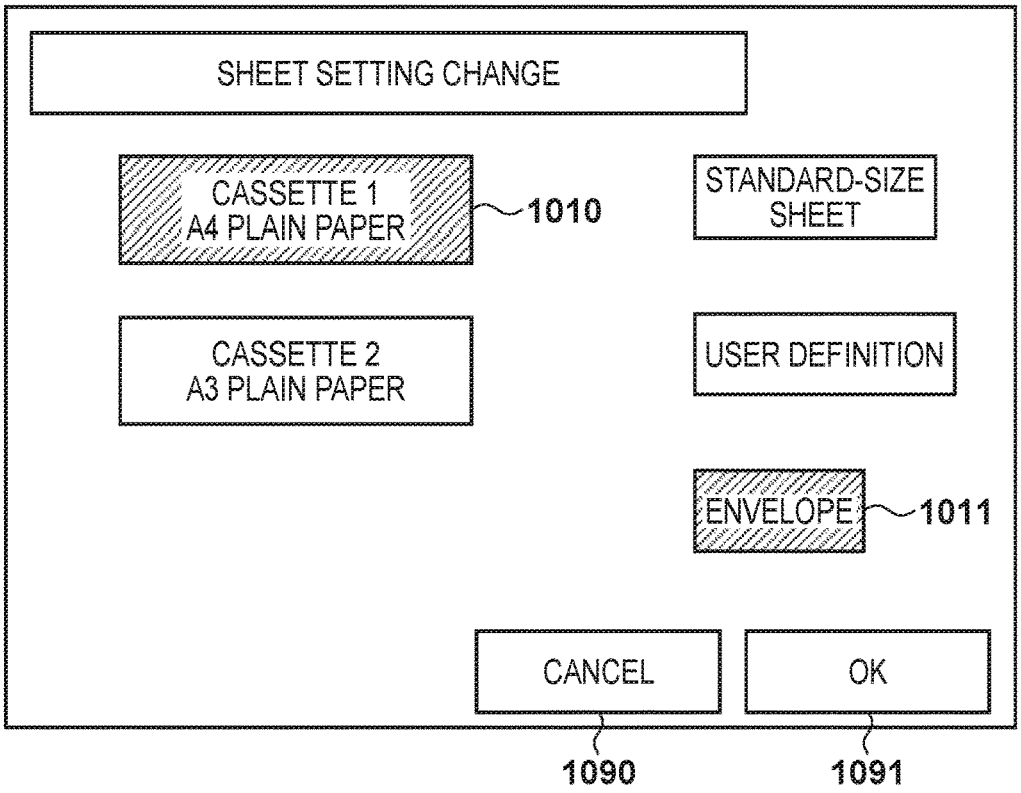
FIG. 10 depicts an example of a sheet setting screen displayed on a display unit when a sheet setting button shown in FIG. 9 is pressed in the first embodiment.

FIG. 10 depicts an example of the sheet setting screen displayed on the display unit 901 when the sheet setting button 920 is pressed in the first embodiment. Note that in FIG. 10, "CASSETTE 1" corresponds to the paper feed cassette 310, and "CASSETTE 2" corresponds to the paper feed cassette 311.

Referring to FIG. 10, paper feed cassettes and printing medium types are displayed as setting targets, and the user can select a desired paper feed cassette and desired printing medium type. In FIG. 10, a button 1010 indicating CASSETTE 1 (the paper feed cassette 310) is selected as a paper feed cassette, an envelope button 1011 is selected as a printing medium type as a setting target, and these buttons are highlighted. If a cancel button 1090 is pressed in this state shown in FIG. 10, the CPU 111 ends and closes this sheet setting screen, and returns to the basic screen shown in FIG. 9. If an OK button 1091 is pressed in the state shown in FIG. 10, the process advances to step S402.

Figure 11:
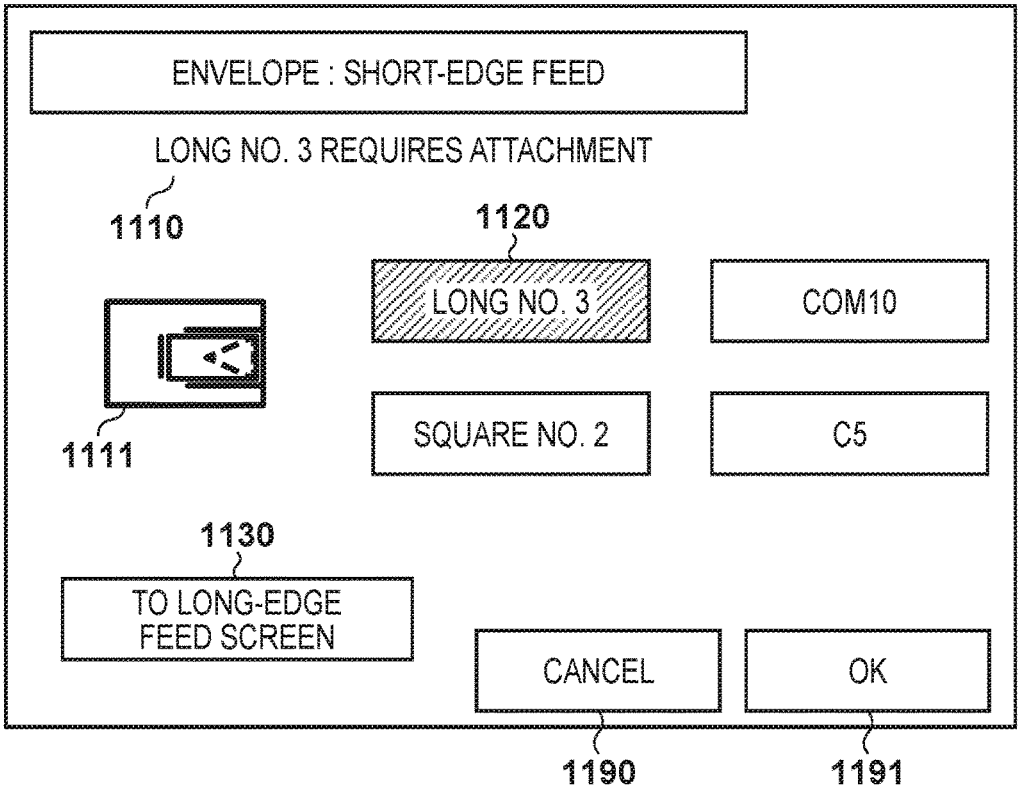
FIG. 11 depicts an example of an envelope selecting screen according to the first embodiment.

In step S402, the CPU 111 displays an envelope selecting screen as shown in FIG. 11 on the display unit 901.

FIG. 11 depicts an example of the envelope selecting screen according to the first embodiment.

FIG. 11 shows, as an initial screen, a state in which "SHORT-EDGE FEED" is selected as a mode, and a "LONG NO. 3" button 1120 for designating "long No. 3" is selected as the type of envelope.

In step S403, the CPU 111 determines whether the user has selected the type of envelope in the envelope selecting screen shown in FIG. 11. If the user has selected an envelope, the CPU 111 advances the process to step S404. If the user has not selected any envelope in step S403, the CPU 111 advances the process to step S406. In step S404, the CPU 111 refers to the table shown in FIG. 8 based on the envelope type selected in step S402 and the feed direction of the envelope, and determines whether an attachment is necessary for the selected envelope. If it is determined in step S404 that an attachment is necessary, the process advances to step S405, and the CPU 111 displays, for example, a message "LONG NO. 3 REQUIRES ATTACHMENT" as indicated by 1110 in FIG. 11, thereby prompting the user to attach the attachment to the paper feed cassette 310. In addition, the CPU 111 displays an illustration 1111 indicating the shape of the attachment, and advances the process to step S406. On the other hand, if it is determined in step S404 that no attachment is necessary, the CPU 111 advances the process to step S406.

Since short-edge feed is set in FIG. 11, the attachment illustration 1111 is also the short-edge feed attachment 501 (FIG. 5). Accordingly, the user sets the short-edge feed attachment 501 in the paper feed cassette 310 in accordance with this display, and sets a long No. 3 envelope in the paper feed cassette 310.

If the CPU 111 detects in step S406 that the user has pressed the OK button 1191, the CPU 111 advances the process to step S408, and completes the setting for the envelope. In step S408, the CPU 111 updates sheet setting information, and feeds the long No. 3 envelope from the paper feed cassette 310, thereby enabling printing. On the other hand, if the user has not pressed the OK button 1191 in step S406, the process advances to step S407, and the CPU 111 determines whether the cancel button 1190 is pressed. If it is determined that the cancel button 1190 is pressed, the process returns to step S401, and the CPU 111 displays the sheet setting screen shown in FIG. 10. If the cancel button 1190 is not pressed in step S407, the process returns to step S403.

Next, a case in which no envelope attachment is necessary will be explained with reference to the flowchart of FIG. 4 and FIG. 12.

Figure 12:
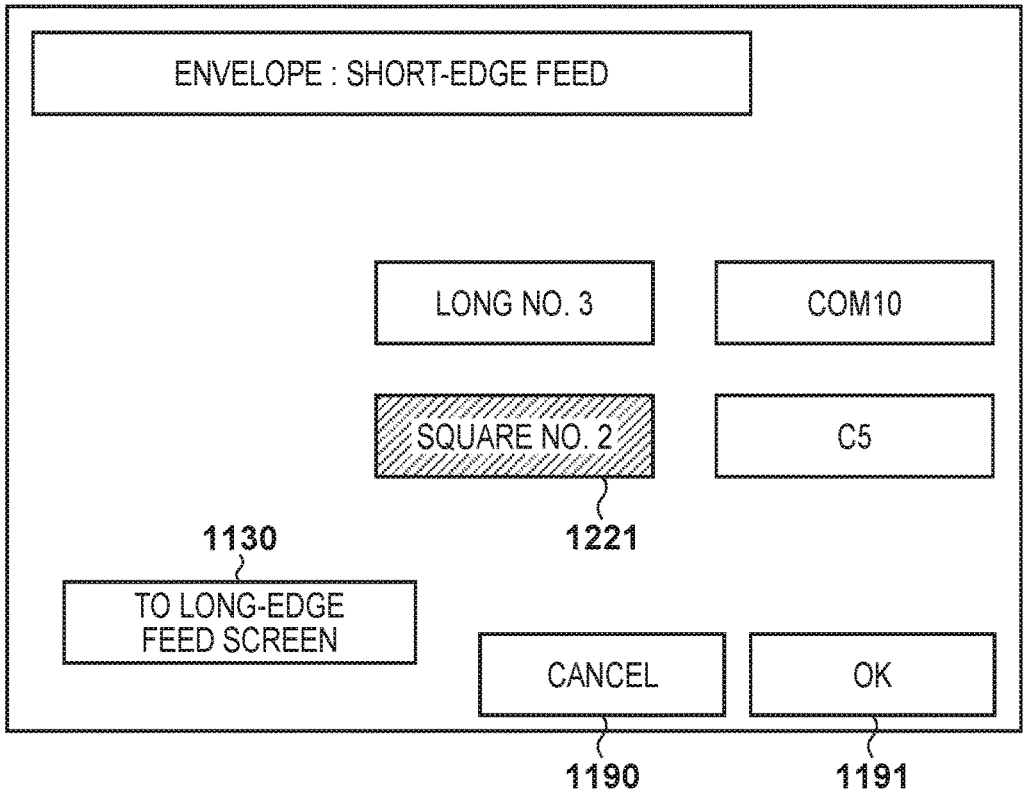
FIG. 12 depicts another example of the envelope selecting screen according to the first embodiment.

FIG. 12 depicts another example of the envelope selecting screen according to the first embodiment.

Referring to FIG. 12, a "SQUARE NO. 2" button 1221 is pressed, and a square No. 2 envelope is selected for short-edge feed. If the user selects a square No. 2 envelope in step S403 of FIG. 4, the process advances to step S404, and whether an envelope attachment is necessary is determined. In this case, it is determined that no attachment is necessary from the table shown in FIG. 8.

Referring to FIG. 12, therefore, the message 1110 and the attachment illustration 1111 as shown in FIG. 11 are not displayed. This prompts the user to set the selected square No. 2 envelope in the paper feed cassette 310 without using any attachment. Then, the user sets the square No. 2 envelope in the paper feed cassette 310, and presses the OK button 1191 in step S406. In step S408, the CPU 111 updates the sheet setting, thereby enabling a printing operation on the envelope. Note that in FIG. 12, it is also possible to display, for example, a message "NO ATTACHMENT IS NECESSARY" in place of the message 1110 shown in FIG. 11.

Figure 13:
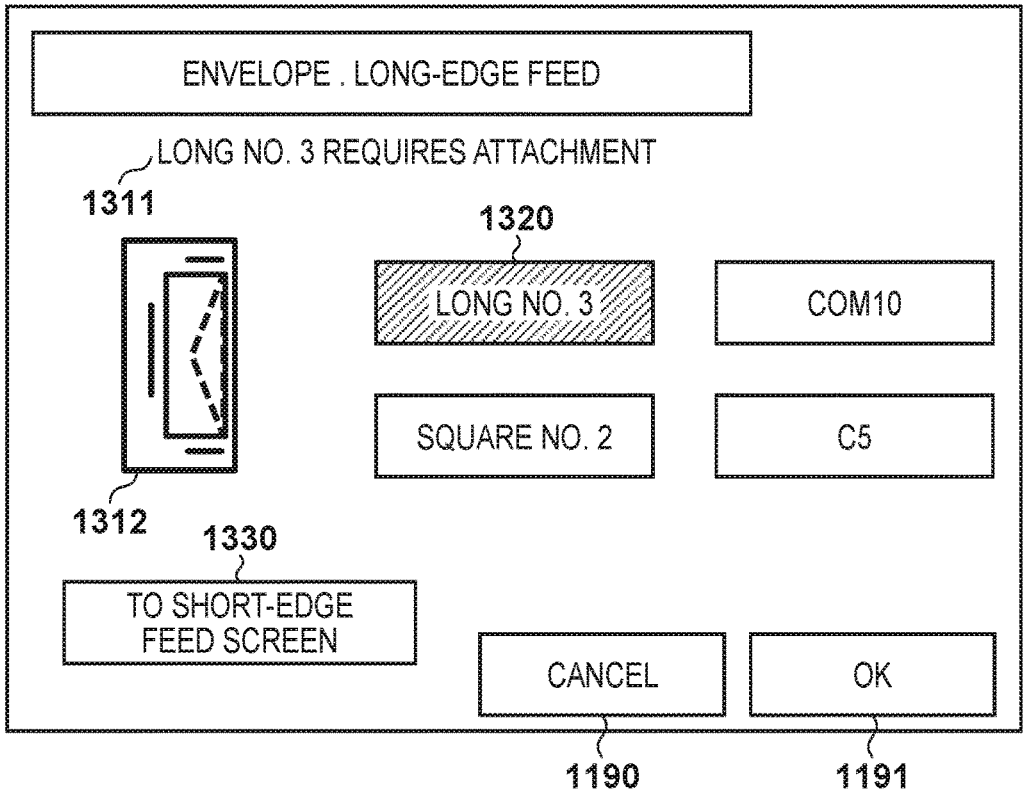
FIG. 13 depicts still another example of the envelope selecting screen according to the first embodiment.

FIG. 13 depicts still another example of the envelope selecting screen according to the first embodiment.

FIG. 13 shows, as an initial screen, a state in which "LONG-EDGE FEED" is selected as a mode, and a "LONG No. 3" button 1320 indicating "long No. 3" is selected as the type of envelope. Referring to FIG. 13, whether an attachment is necessary for the selected envelope is determined by referring to the table shown in FIG. 8 based on the type of the selected envelope and the feed direction of the envelope. In this example, it is determined in step S404 that the attachment is necessary. Therefore, as indicated by, for example, 1311 in FIG. 13, a message "LONG NO. 3 REQUIRES ATTACHMENT" is displayed, thereby prompting the user to attach the attachment to the paper feed cassette 310. In addition, as an attachment illustration 1312, an illustration of the long-edge feed attachment 601 (FIG. 6) is displayed. Accordingly, the user sets the long-edge feed attachment 601 in the paper feed cassette 310 in accordance with this display, and sets the long No. 3 envelope in the paper feed cassette 310.

Figure 14:
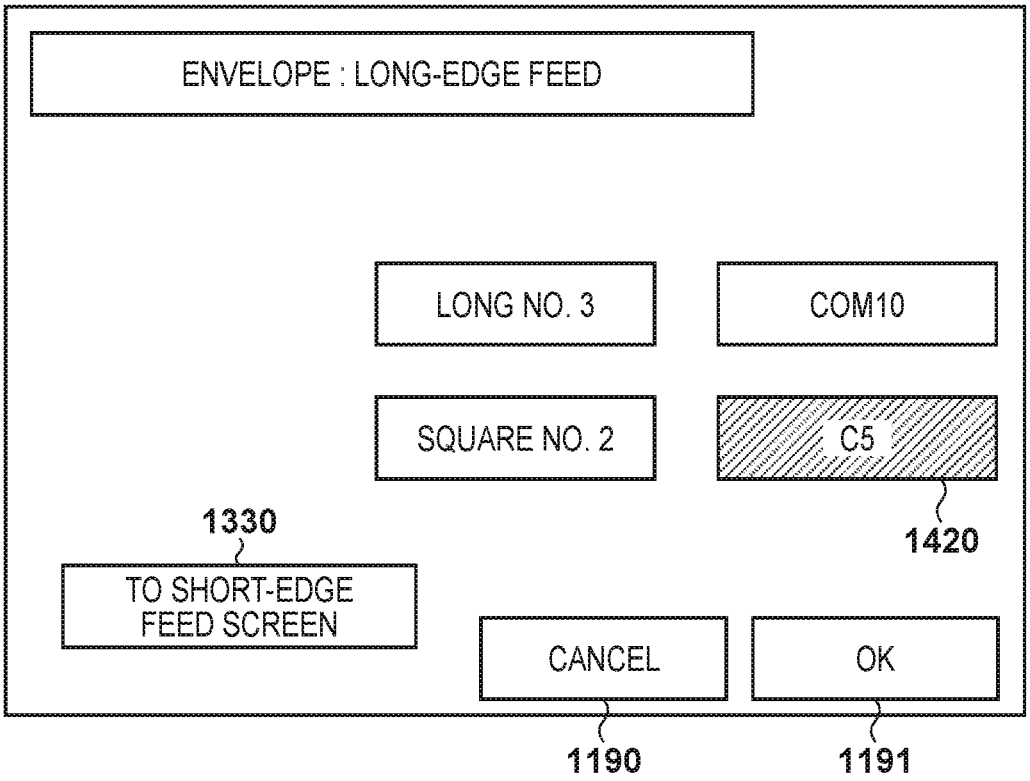
FIG. 14 depicts still another example of the envelope selecting screen according to the first embodiment.

FIG. 14 depicts still another example of the envelope selecting screen according to the first embodiment.

Referring to FIG. 14, a C5 button 1420 is pressed to select a C5 envelope in a long-edge feed mode. If the user selects a C5 envelope in step S403 of FIG. 4, the process advances to step S404, and whether an envelope attachment is necessary is determined. In this step, it is determined that no attachment is necessary based on the table shown in FIG. 8. In FIG. 14, therefore, the message 1311 and the attachment illustration 1312, as shown in FIG. 13, are not displayed. This prompts the user to set a C5 envelope in the paper feed cassette 310 without using any attachment. Accordingly, the user sets the C5 envelope in the paper feed cassette 310, and presses the OK button 1191 in step S406. In step S408, the CPU 111 updates the sheet setting, thereby enabling a printing operation on the envelope. Note that in FIG. 14, it is also possible to display, for example, a message "NO ATTACHMENT IS NECESSARY" in place of the message 1311 shown in FIG. 13. The cancel button 1190 is a button for canceling the setting on this screen and returning to the screen shown in FIG. 10.

Note that when a "TO LONG-EDGE FEED SCREEN" button 1130 is pressed on the screen shown in FIG. 11, the screen shifts to the long-edge feed envelope selecting screen as shown in FIG. 13. On the other hand, when a "TO SHORT-EDGE FEED SCREEN" button 1330 is pressed on the screen shown in FIG. 13, the screen shifts to the short-edge feed envelope selecting screen as shown in FIG. 11.

In the first embodiment as explained above, whether an attachment is necessary to set an envelope in a paper feed cassette is displayed by only designating the type and the feed direction of the envelope. Also, if the attachment is necessary, an illustration of the attachment is displayed. This prevents the user from attaching a wrong attachment. This makes it possible to solve the problem that it is difficult to determine whether an attachment is necessary and the type of attachment when using an envelope as a printing medium.

Second Embodiment

As the second embodiment of the present invention, a case in which the type of envelope is changed for another job, after a job has been executed, by setting an envelope, or whether an envelope attachment is necessary changes because the setting of the feed direction of an envelope is changed will be explained.

Processing according to the second embodiment is different in only processes corresponding to steps S404 and S405 shown in FIG. 4 of the above-described first embodiment, so the differences from the first embodiment will be explained with reference to FIGS. 19, 15, and 16. Note that the hardware configuration and the mechanism of an image forming apparatus 100 according to the second embodiment are the same as those of the above-described first embodiment, so an explanation thereof will be omitted.

Figure 19:
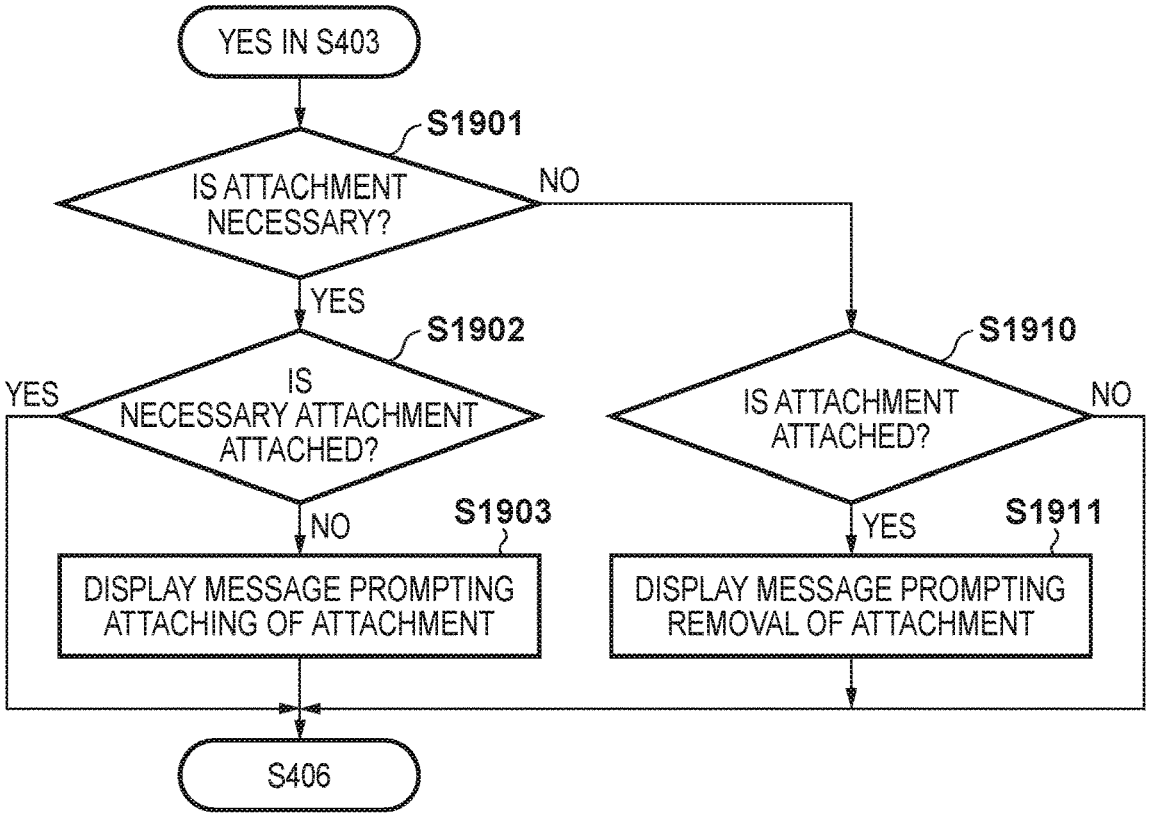
FIG. 19 is a flowchart for describing the processing of an image forming apparatus 100 according to a second embodiment.

FIG. 19 is a flowchart for describing the processing of the image forming apparatus 100 according to the second embodiment, and shows processes to be inserted between steps S403 and S406 in FIG. 4 described previously.

If it is determined in step S403 of FIG. 4 that the user has pressed the button 1011 for designating the type of envelope, the process advances to step S1901, and the CPU 111 determines based on the direction (feed direction) and the type of the designated envelope whether an envelope attachment is necessary. If the CPU 111 determines in step S1901 that the envelope attachment is necessary, the process advances to step S1902, and the CPU 111 determines whether the envelope attachment is presently attached to the paper feed cassette 310. The image forming apparatus 100 according to the second embodiment does not include a mechanism for detecting the attached state of the attachment by hardware. Therefore, the CPU 111 estimates the present configuration of the paper feed cassette 310 from the setting information about the envelope direction and envelope type lastly set by the user, and performs the determination based on the estimation result. If the CPU 111 determines in step S1902 that the necessary envelope attachment is not attached, the CPU 111 advances the process to step S1903, and displays, for example, a screen as shown in FIG. 16, thereby prompting the user to attach the attachment. On the other hand, if the CPU 111 determines in step S1902 that the necessary attachment is attached, the CPU 111 advances the process to step S406.

Figure 16:
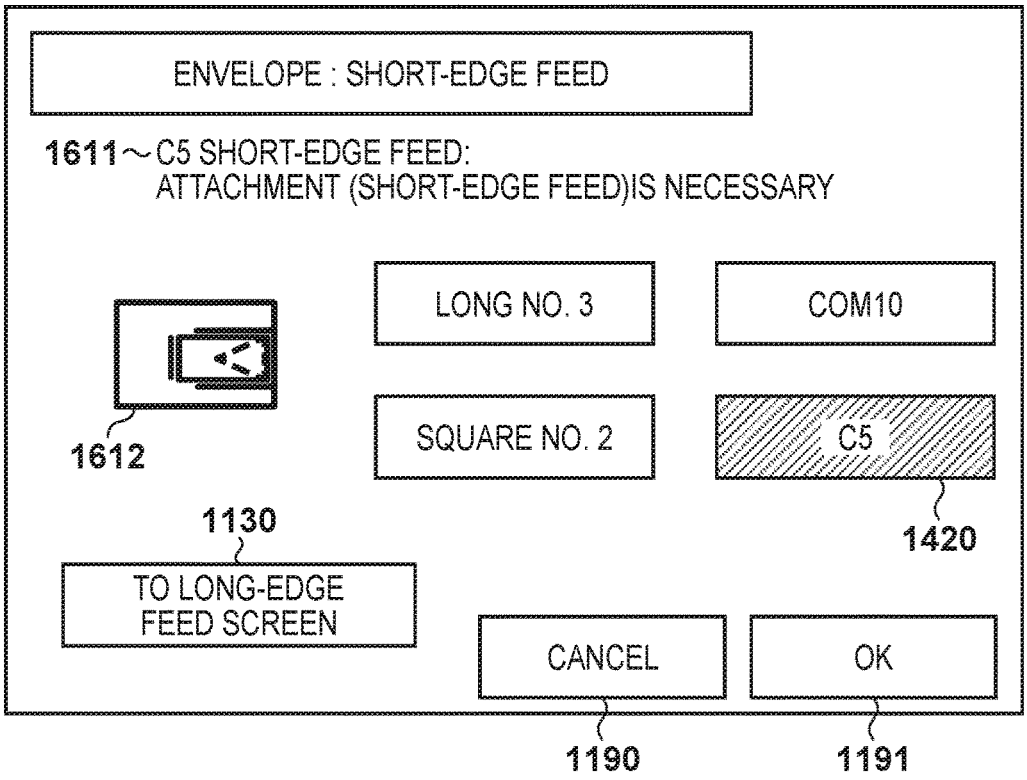
FIG. 16 depicts an example of an envelope selecting screen when the setting is changed from C5-envelope long-side feed requiring no attachment shown in FIG. 14 to C5-envelope short-side feed requiring an attachment.

FIG. 16 depicts an example of an envelope selecting screen according to the second embodiment when the setting is changed from the state of C5 long-edge feed requiring no attachment shown in FIG. 14 to C5 short-edge feed requiring an attachment.

Referring to FIG. 16, a message 1611 "C5 SHORT-EDGE FEED: ATTACHMENT (SHORT-EDGE FEED) IS NECESSARY" and an attachment illustration 1612 are displayed, thereby prompting the user to attach the attachment.

On the other hand, if the CPU 111 determines in step S1901 that no attachment is necessary, the process advances to step S1910, and the CPU 111 determines whether an attachment is presently attached. As in step S1902, the CPU 111 estimates the present configuration of the paper feed cassette 310 from the setting information about the envelope direction and envelope type lastly set by the user, and performs the determination based on the estimation result. If it is determined that no attachment is attached, the envelope need only be stacked in the paper feed cassette 310, so nothing is displayed, and the process advances to step S406. On the other hand, if it is determined that an attachment is attached, the process advances to step S1911, and the CPU 111 displays a message prompting the user to remove the attachment from the paper feed cassette 310. After that, the process advances to step S406.

Figure 15:
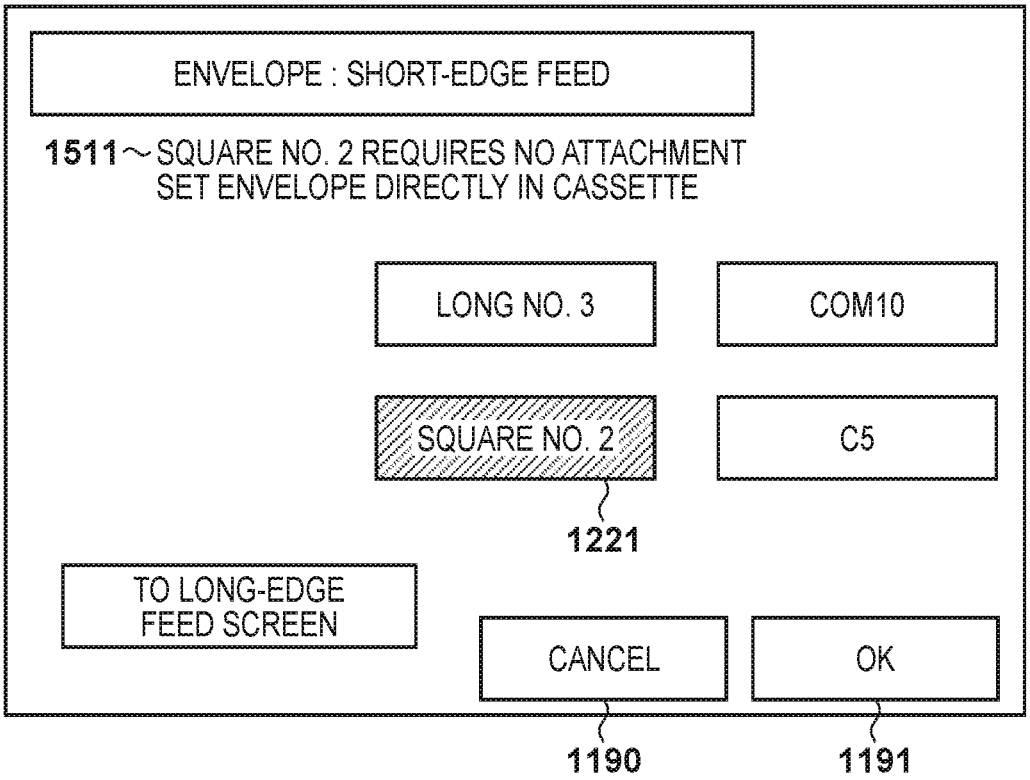
FIG. 15 depicts an example of a screen displayed in step S1911 when the setting of an envelope requiring an attachment is changed to a square No. 2 (K2) envelope requiring no attachment in the second embodiment.

FIG. 15 depicts a screen example displayed in step S1911 when the setting of an envelope requiring an attachment is changed to square No. 2 requiring no attachment in the second embodiment.

Referring to FIG. 15, a "SQUARE NO. 2" button 1221 is selected for short-edge feed, so it is determined that no attachment is necessary by referring to the table shown in FIG. 8. Therefore, a message 1511 prompting the user to remove the attachment is displayed, and an attachment illustration is erased.

In the second embodiment, as explained above, even when whether an envelope attachment is necessary is changed because the user has changed the envelope setting, the user can be notified by turning on/off the display of whether an attachment is necessary and the display of an attachment illustration.

Third Embodiment

The third embodiment of the present invention will be explained below with reference to the envelope selecting screens shown in FIGS. 17 and 18, and the flowchart shown in FIG. 20. In the third embodiment, a control circuit or detection software processing capable of automatically identifying the presence/absence of an envelope attachment and the type of attached attachment is added to the image forming apparatus 100 according to the second embodiment. The CPU 111 is notified of information about the presence/absence of an attachment and the type of attachment detected by the control circuit of software, and the information is used to control the display of an envelope selecting screen. Note that the hardware configuration and the mechanism of the image forming apparatus 100 according to the second embodiment are basically the same as those explained in the above-described first embodiment, so an explanation thereof will be omitted.

Figure 20:
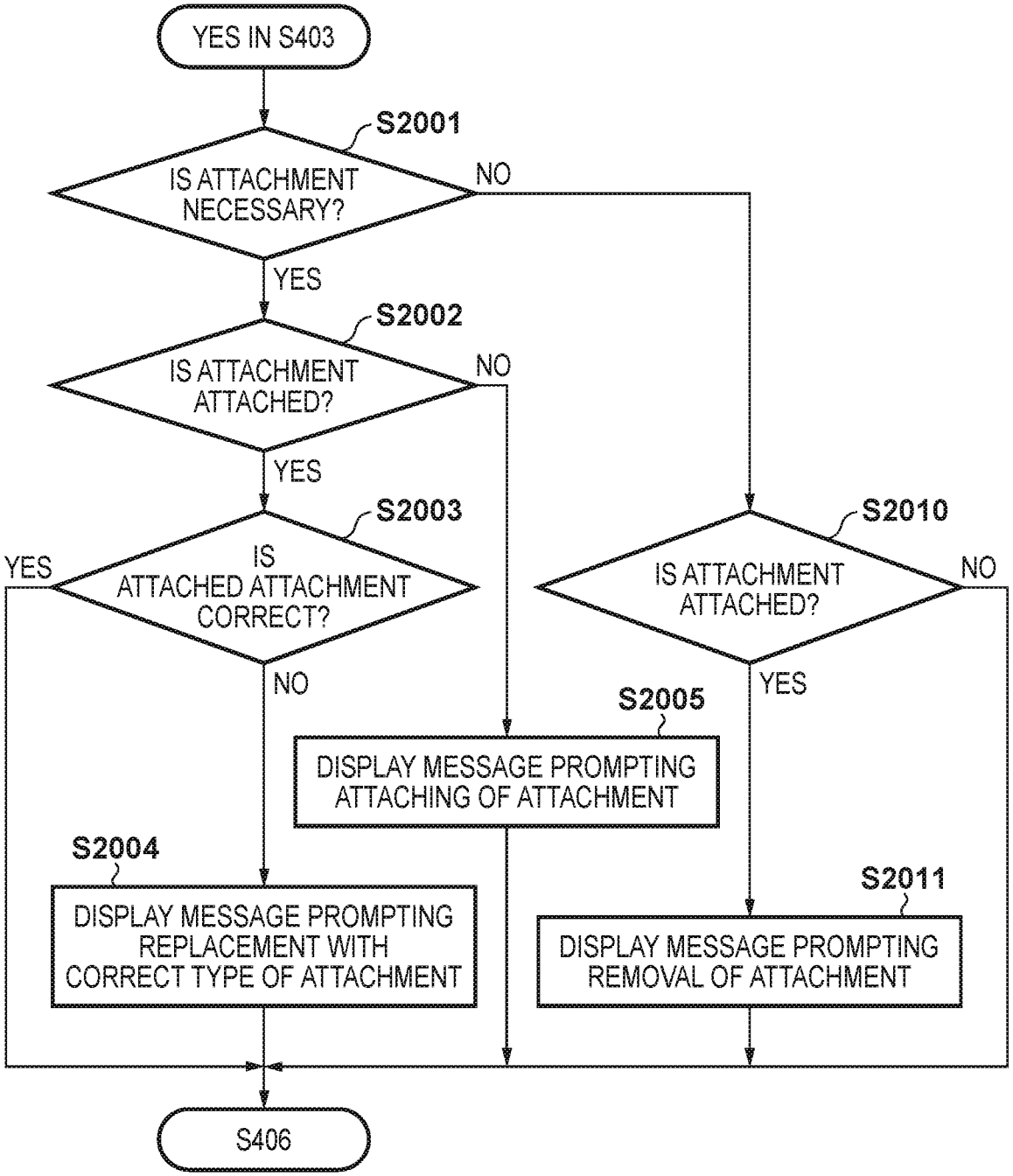
FIG. 20 is a flowchart for describing the processing of an image forming apparatus according to the third embodiment.

FIG. 20 is a flowchart for describing processing of an image forming apparatus 100 according to the third embodiment, and shows processes to be inserted between steps S403 and S406 in FIG. 4 described earlier.

If the CPU 111 determines in step S403 that the user has selected an envelope, the CPU 111 determines in step S2001 whether an envelope attachment is necessary. If the CPU 111 determines that the attachment is necessary, the CPU 111 advances the process to step S2002, and determines whether the attachment is attached. If the CPU 111 determines in step S2002 that the attachment is attached, the process advances to step S2003, and the CPU 111 acquires the type (short-edge feed or long-edge feed) of the attached attachment. Then, the process advances to step S2003, and the CPU 111 determines whether the type of attachment is correct for the envelope selection setting. If it is determined that the attachment type is incorrect, the process advances to step S2004, and the CPU 111 displays a screen prompting the user to replace the attachment with an appropriate attachment, and advances the process to step S406.

Figure 18:
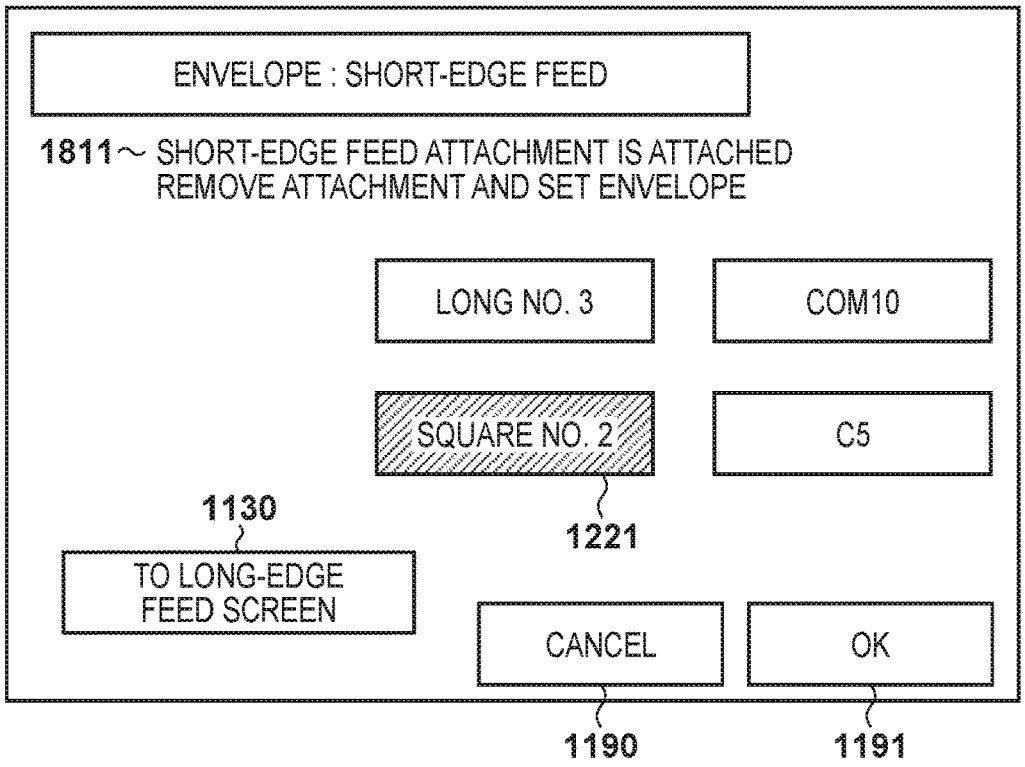
FIG. 18 depicts an example of the envelope selecting screen to be displayed in step S2004 according to the third embodiment.

FIG. 18 depicts an example of the envelope selecting screen displayed in step S2004 according to the third embodiment.

Referring to FIG. 18, a message 1811 indicates that an attachment is attached but this attachment is inappropriate for the type and feed direction of an envelope to be used, and prompts the user to remove the attachment.

On the other hand, if the CPU 111 determines in step S2002 that no attachment is attached, the CPU 111 advances the process to step S2005, and displays a message prompting the user to attach the attachment.

Figure 17:
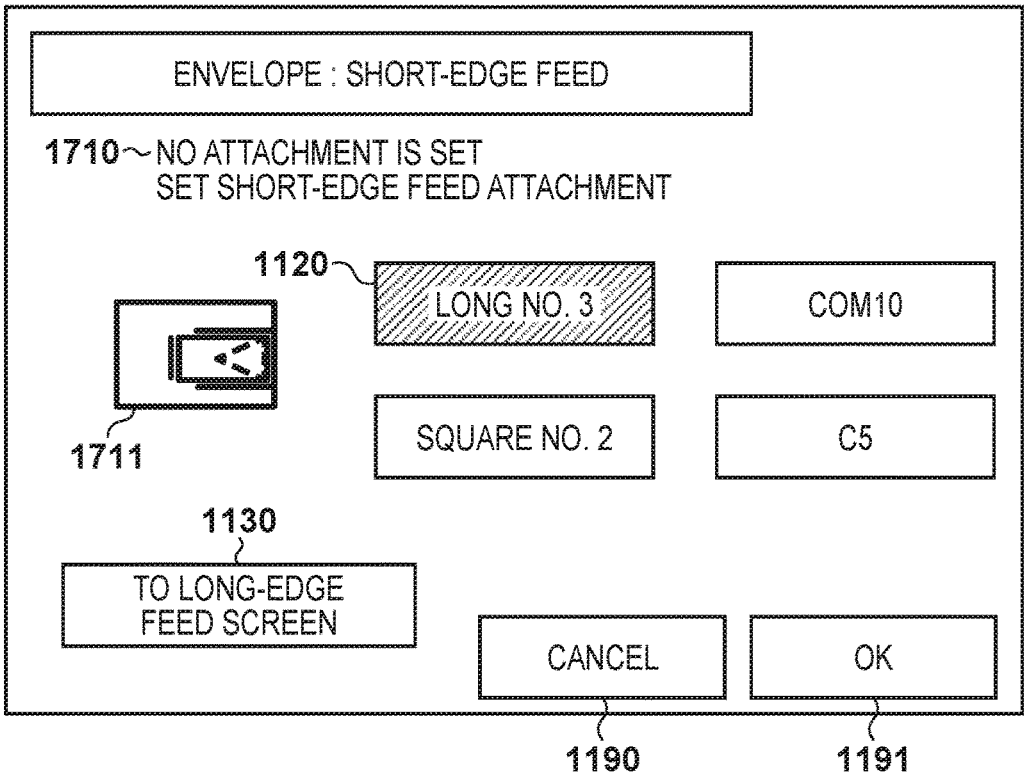
FIG. 17 depicts an example of an envelope selecting screen to be displayed in step S2005 according to a third embodiment.

FIG. 17 depicts an example of the envelope selecting screen displayed in step S2005 according to the third embodiment.

Referring to FIG. 17, a "LONG NO. 3" button 1120 is selected for short-edge feed, so an attachment is necessary. Since, however, this attachment is not attached, a message 1710 notifies the user that no attachment is attached and a short-edge feed attachment is necessary. In addition, whether the short-edge feed attachment is necessary is expressed by displaying an attachment illustration 1711.

If the CPU 111 determines in step S2001 that no attachment is necessary, the process advances to step S2010, and the CPU 111 determines whether an attachment is attached. If no attachment is attached, nothing is displayed, and the process advances to step S406. On the other hand, if it is determined in step S2010 that an attachment is attached, the process advances to step S2011, and the CPU 111 displays a message prompting the user to remove the attachment because the attachment is unnecessary. After that, the process advances to step S406. Note that the screen display in step S2011 is the same as that shown in FIG. 19 explained in the above-described second embodiment.

In the third embodiment as explained above, even when whether an envelope attachment is necessary changes because the user has changed the envelope setting, the user can be notified of whether the attachment is necessary, as in the second embodiment.

Other Embodiments

Embodiments of the present invention can also be realized by a computer of a system or an apparatus that reads out and executes computer executable instructions (e.g., one or more programs) recorded on a storage medium (that may also be referred to more fully as 'non-transitory computer-readable storage medium') to perform the functions of one or more of the above-described embodiments and/or that includes one or more circuits (e.g., an application specific integrated circuit (ASIC)) for performing the functions of one or more of the above-described embodiments, and by a method performed by the computer of the system or the apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., a central processing unit (CPU), or a micro processing unit (MPU)) and may include a network of separate computers or separate processors to read out and to execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), a digital versatile disc (DVD), or a Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a stacking unit capable of stacking a plurality of envelopes;

an image forming unit that forms an image on an envelope conveyed from the stacking unit;

a rear-end regulating plate, provided on the stacking unit, that regulates an upstream end of the envelope stacked on the stacking unit in a conveyance direction of the envelope;

side regulating plates, provided on the stacking unit, that regulate both side ends of the envelope stacked on the stacking unit, in a direction perpendicular to the conveyance direction of the envelope and a thickness direction of the envelope;

an attachment, removably mounted on the stacking unit, that is configured to be installed within the stacking unit, and that regulates an upstream end in the conveyance direction of an envelope stacked on the stacking unit by abutting against a trailing end of the envelope;

an operation unit having a display, that accepts a size of an envelope stacked on the stacking unit via an instruction by a user; and a controller that controls the display, based on envelope information relating to the size of the envelope accepted by the operation unit, wherein the controller controls the display to display information for prompting the user to mount the attachment on the stacking unit in a case that the size of the envelope is smaller than a predetermined size.

2. The image forming apparatus according to claim 1, wherein the controller specifies the attachment corresponding to the size of the envelope accepted by the operation unit and displays the information on the operation unit prompting the user to mount the specified attachment on the stacking unit.

3. The image forming apparatus according to claim 1, wherein the controller displays the information, together with an illustration indicating a shape of the attachment, on the operation unit.

4. The image forming apparatus according to claim 1, wherein the size of the envelope is selected via a selection screen of envelopes displayed on the operation unit.

5. The image forming apparatus according to claim 1, wherein the attachment is mounted on the stacking unit to cover the rear-end regulating plate.

6. The image forming apparatus according to claim 1, wherein the attachment is mounted on the stacking unit to cover the side regulating plates.

7. The image forming apparatus according to claim 1, wherein the envelope information includes information related to a name of an envelope.

8. The image forming apparatus according to claim 1, wherein the envelope information includes information related to a type of envelope.

9. The image forming apparatus according to claim 1, wherein the controller controls the display to display the information in a case a type of the envelope is COM10.

10. The image forming apparatus according to claim 1, wherein the controller controls the display to display the information in a case a type of the envelope is LONG No. 3.

* * * * *